US006478163B1

(12) United States Patent
Otsuka

(10) Patent No.: US 6,478,163 B1
(45) Date of Patent: Nov. 12, 2002

(54) DECANTER TYPE CENTRIFUGAL SEPARATOR

(75) Inventor: Takaharu Otsuka, Yachiyo (JP)

(73) Assignee: Tomoe Engineering Co., Ltd., Tokyo (JP)

( * ) Notice: Subject to any disclaimer, the term of this patent is extended or adjusted under 35 U.S.C. 154(b) by 0 days.

(21) Appl. No.: 09/744,143

(22) PCT Filed: May 22, 2000

(86) PCT No.: PCT/JP00/03257

§ 371 (c)(1),
(2), (4) Date: Feb. 27, 2001

(87) PCT Pub. No.: WO00/71260

PCT Pub. Date: Nov. 30, 2000

(30) Foreign Application Priority Data

May 21, 1999 (JP) ..... 11-141178

(51) Int. Cl.[7] ..... B04B 3/04; B04B 1/20; B04B 5/12

(52) U.S. Cl. ..... 210/374; 210/360.1; 210/380.1; 210/380.3; 210/391; 494/36; 494/53; 494/58

(58) Field of Search ..... 210/360.1, 374, 210/380.1, 380.3, 391, 512.1; 494/36, 50, 52, 53, 58

(56) References Cited

U.S. PATENT DOCUMENTS 5,558,235 A * 9/1996 Leung ..... 210/374

FOREIGN PATENT DOCUMENTS

JP 08-089487 A * 4/1996
JP 10-028899 A * 2/1998

* cited by examiner

*Primary Examiner*—David A. Reifsnyder
(74) *Attorney, Agent, or Firm*—Antonelli, Terry, Stout & Kraus, LLP

(57) ABSTRACT

The screw conveyor 200A includes a first flight 211 and a second flight 212 for transporting cake to cake discharging ports 105 in the small diameter section 103. Each flight 211, 212 has a small clearance portion 211*a*, 212*a* defining a small clearance d1 and a large clearance portion 211*b*, 212*b* defining a large clearance d2 between the tip of the flight and the inner peripheral surface of the small diameter section 103. The whole region of the large clearance portion 211*b*, 212*b* of each flight 211, 212 overlaps with the small clearance portion 212*a*, 211*a* of another flight 212, 211 at the same point in the direction of the rotation axis C.

5 Claims, 7 Drawing Sheets

DECANTER TYPE CENTRIFUGAL SEPARATOR

TECHNICAL FIELD

The present invention relates to a decanter centrifuge for separating slurry into liquid and solid cake, and more specifically to a centrifuge for washing the cake effectively.

BACKGROUND OF THE INVENTION

In general, a decanter centrifuge having the capability of draining and washing is widely known, and called a screen bowl type decanter centrifuge.

Referring now to FIG. 7, the typical screen bowl type decanter centrifuge will be described.

The decanter centrifuge comprises a bowl 100 and a screw conveyor 200 rotating in the bowl and rotating relatively thereto.

The bowl 100 comprises a large diameter section 101, a tapered section 102, and a small diameter section 103 formed in a single piece. A clear liquid discharging port, or a dam 104 is formed on the end surface of the large diameter section 101, and cake discharging ports 105 are formed in the vicinity of end portion of the small diameter section 103. The small diameter section 103 is provided with filtrate discharging holes 107 formed on its circumferential wall 108. The inner peripheral surface of the circumferential wall 108 is covered with a porous material 106.

The screw conveyor 200 rotating at a constant differential speed with respect to the bowl 100 comprises a hub 201 as an axis of rotation and a flight 202 fixed on the hub 201. A washing fluid chamber 203 is provided within said hub 201, and washing fluid spray nozzles 204 are provided at the position corresponding to the washing fluid chamber 203.

Slurry, which is an object to be processed, is supplied to the large diameter section 101 through an unrotatable slurry supply pipe 300 within the hub 201. Washing fluid passes through a washing fluid supply pipe 301 provided around the slurry supply pipe 300 and is supplied to the washing fluid chamber 203 described above through a washing fluid supply port 302.

Slurry supplied through the slurry supply pipe 300 to the large diameter section 101 is pressed against the inner peripheral surface of the large diameter section 101 by centrifugal force. Liquid component in the slurry is discharged from the dam 104 formed at the end portion of the large diameter section 101, and the cake in the slurry is transported by the flight 202 through the tapered section 102 and the small diameter section 103, and discharged from the cake discharging ports 105. The cake in the small diameter section 103 is drained while being washed by the washing fluid.

However, in the related art as described thus far, since the cake is forced to be transported by the flight 202 while being formed into generally triangle in cross section with one side situated on the surface of the flight 202 facing toward the cake discharging ports 105, even when the washing fluid is sprayed onto the portion of generally triangle in cross section, most part of the washing fluid just flows over the tilted surface of the cake and does not penetrate into the cake, and thus the effect of the cake washing cannot be expected much. When a large quantity of the washing fluid is supplied to enhance the washing effect, the amount of waste liquid increases as well, thereby hindering the draining effect. Therefore, the filtering section has to be extended to produce a satisfactory draining effect, and as a consequence, the whole length of the apparatus increases, and thus the cost of the apparatus increases as well.

In the related art, an attempt has been made to provide a plate or a knife between the flights at a prescribed distance from the bowl and break the accumulation of the cake before spraying the washing fluid in order to enhance the effect of the cake washing. However, since these parts may resist transportation of the cake, a larger power is required. In addition, since washing of the machine itself is difficult, the accumulated cake may cause so called a blockage and thus the object to be processed cannot be processed in volume stably. In addition, in the related art described above, the number of components increases and thus the cost of the apparatus also increases.

DISCLOSURE OF INVENTION

With the problems described above in view, it is an object of the present invention to provide a decanter centrifuge that can enhance the effect of the cake washing without increasing the quantity of the washing fluid supplied and without increasing the number of components.

In order to achieve the object described above, the decanter centrifuge of this invention comprises:

- a bowl;
- a screw conveyer provided in the bowl so as to rotate relatively to the bowl;
- the bowl comprising a cylindrical large diameter section into which slurry is supplied, a tapered section having the diameter decreasing from the large diameter section, and a small diameter section connected to the side of the tapered section having a smaller diameter;
- the small diameter section being provided with fine filtrate discharging holes formed on a part or all over the circumferential wall thereof and with cake discharging ports at the end opposite from the large diameter section;
- the small diameter section being provided with washing fluid supply means for supplying washing fluid to the cake transported from the large diameter section through the tapered section;
- wherein the screw conveyor includes a plurality of flights for transporting the cake to the cake discharging ports in the small diameter section;
- the plurality of flights includes a small clearance portion defining a small clearance and a large clearance portion defining a large clearance between the tip of the flight and the inner peripheral surface of the small diameter section respectively;
- the whole region of the large clearance portion of the plurality of the flights overlaps with the small clearance portion of another flight located at the same axial position of the screw conveyer.

The large clearance means a clearance of at least double the small clearance in size.

In the decanter centrifuge, the washing fluid supply means is preferably provided in the large clearance portion on the side facing to the large diameter section. In addition, the washing fluid supply means is preferably provided so as to be able to spray the washing fluid onto the surface of the large clearance portion of the flight on the side facing to the large diameter section.

In the decanter centrifuge, the large clearance portion of the flight and the small clearance portion of another flight located at the same axial positions are preferably provided in such a manner that when the large clearance portion makes at least a half turn, the small clearance portion passes through the same point.

In addition, in the decanter centrifuge described above, the depth of the large clearance and the length of the large clearance portion are preferably defined in such a manner that cake located at the large clearance portion on the side facing to the cake discharging ports passes through the large clearance formed between the inner peripheral surface of the small diameter section and the large clearance portion while forming a cake residue layer having the same thickness as the large clearance on the side of the large clearance portion facing to the large diameter section, and the contact pressure from cake is not applied to the surface of the large clearance portion of the flight facing to the cake discharging ports immediately before the large clearance portion ends and the small clearance portion starts.

As is described thus far, according to the present invention, since a large clearance portion is formed on the flight, and the washing fluid is supplied onto the thin cake residue layer having passed therethrough, the washing effect can be enhanced without increasing the number of components or the amount of the washing fluid. Especially, the decanter centrifuge in which the washing fluid is supplied to the surface of the large clearance portion of the flight on the side facing to the large diameter section can further enhance the washing effect since the washing fluid is supplied uniformly onto the whole surface of the thin cake residue layer.

BEST MODE FOR CARRYING OUT THE INVENTION

Referring now to FIG. 1 to FIG. 6, various embodiments of the decanter centrifuge according to the present invention will be described.

In a first place, a decanter centrifuge according to the first embodiment of the present invention will be described referring to FIG. 1 to FIG. 5.

Figure 1:
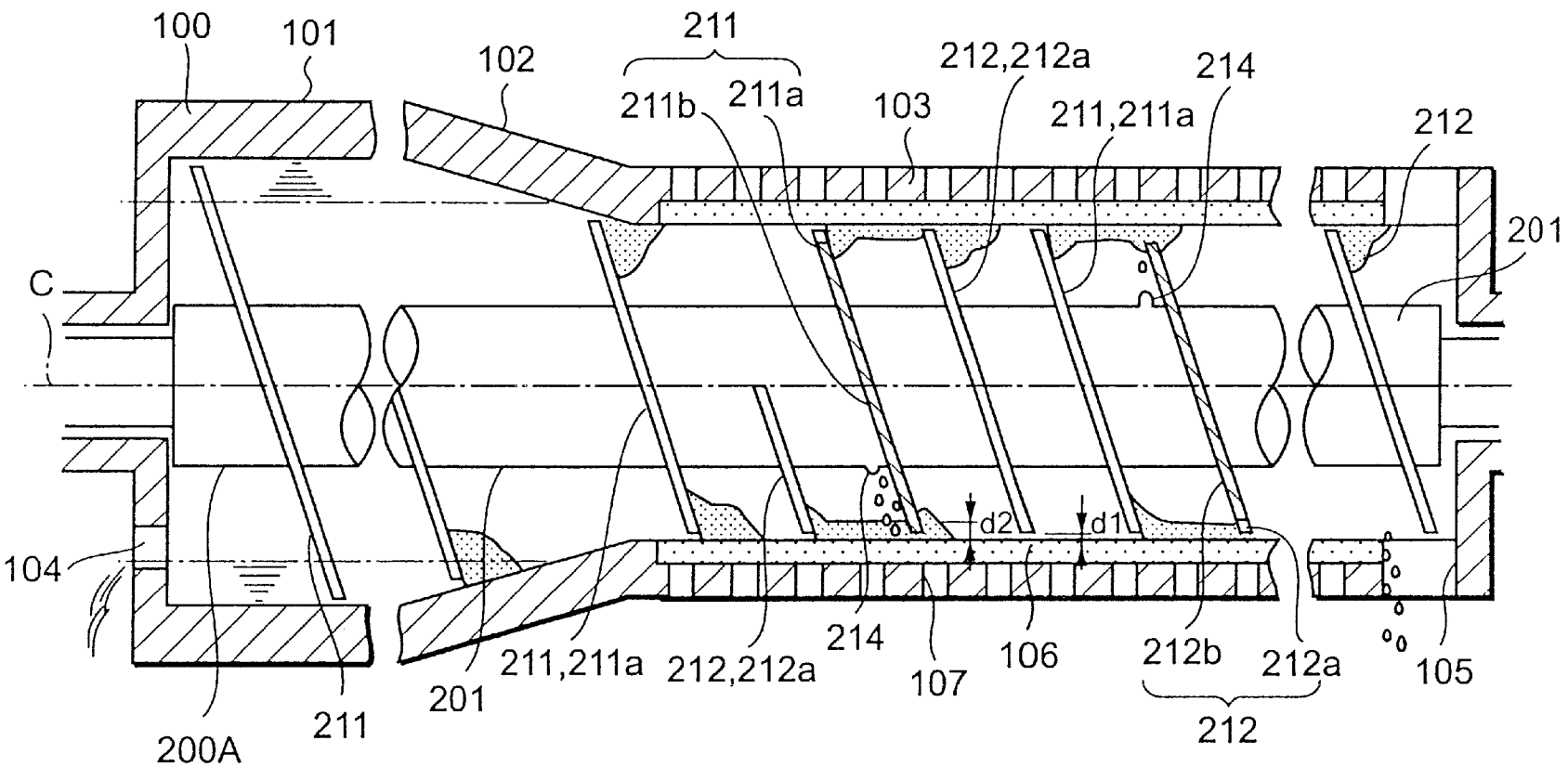
FIG. 1 is a cross sectional view of the decanter centrifuge according to the first embodiment of the present invention.
Figure 7:
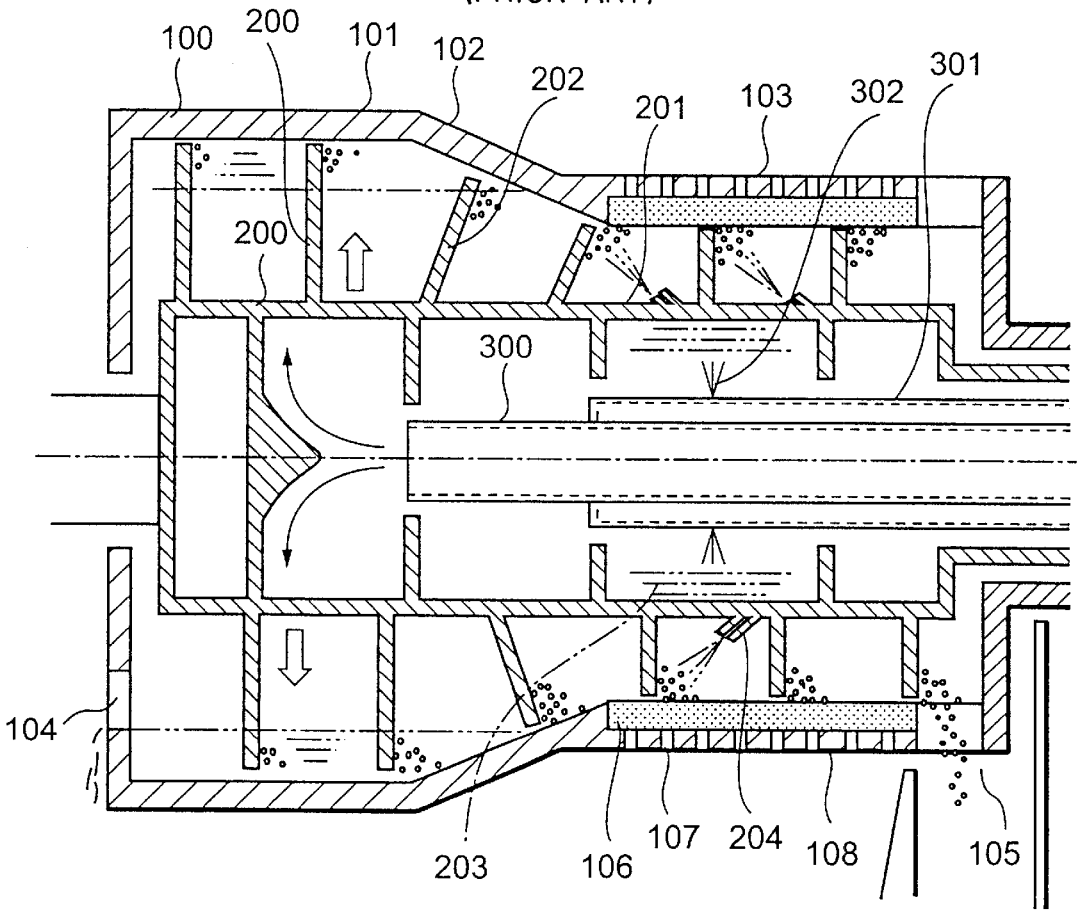
FIG.7 (PRIOR ART)
FIG. 7 is a cross sectional view of a screen bowl type decanter centrifuge of the related art.

The decanter centrifuge of this embodiment is basically the same as the decanter centrifuge of the prior art described referring to FIG. 7, and comprises a bowl 100 and a screw conveyor 200A (shown in FIG. 1). However, the structure of the flight in the small diameter section 103 of the bowl 100 and the mounting position and the mounting direction of the washing fluid spray nozzles are different from the centrifugal separator of the related art. Therefore, identical reference numerals designate portions identical to the centrifugal separator of the related art, and the description thereof is omitted. Only the portions different from the related art are described in detail in the following sections.

As shown in FIG. 1, in the small diameter section 103, the hub 201 of the screw conveyor 200A is provided with a first flight 211 and a second flight 212. Each flight 211, 212 comprises small clearance portions 211*a*, 212*a* each defining a small clearance d1 between the tip of the flight and the inner peripheral surface of the small diameter section 103, and a large clearance portion 211*b*, 212*b* each defining a large clearance d2 therebetween. In FIG. 1, the hollow portions of the flight represent the small clearance portions 211*a*, 212*a*, and the checkered portions represent the large clearance portions 211*b*, 212*b*. The washing fluid spray nozzles 214 are disposed at the large clearance portions 211*b*, 212*b* on the side facing to the large diameter section (the rear side) so as to point the direction in which the washing fluid can be sprayed onto the surface of the flight facing to the large diameter section.

Figure 2:
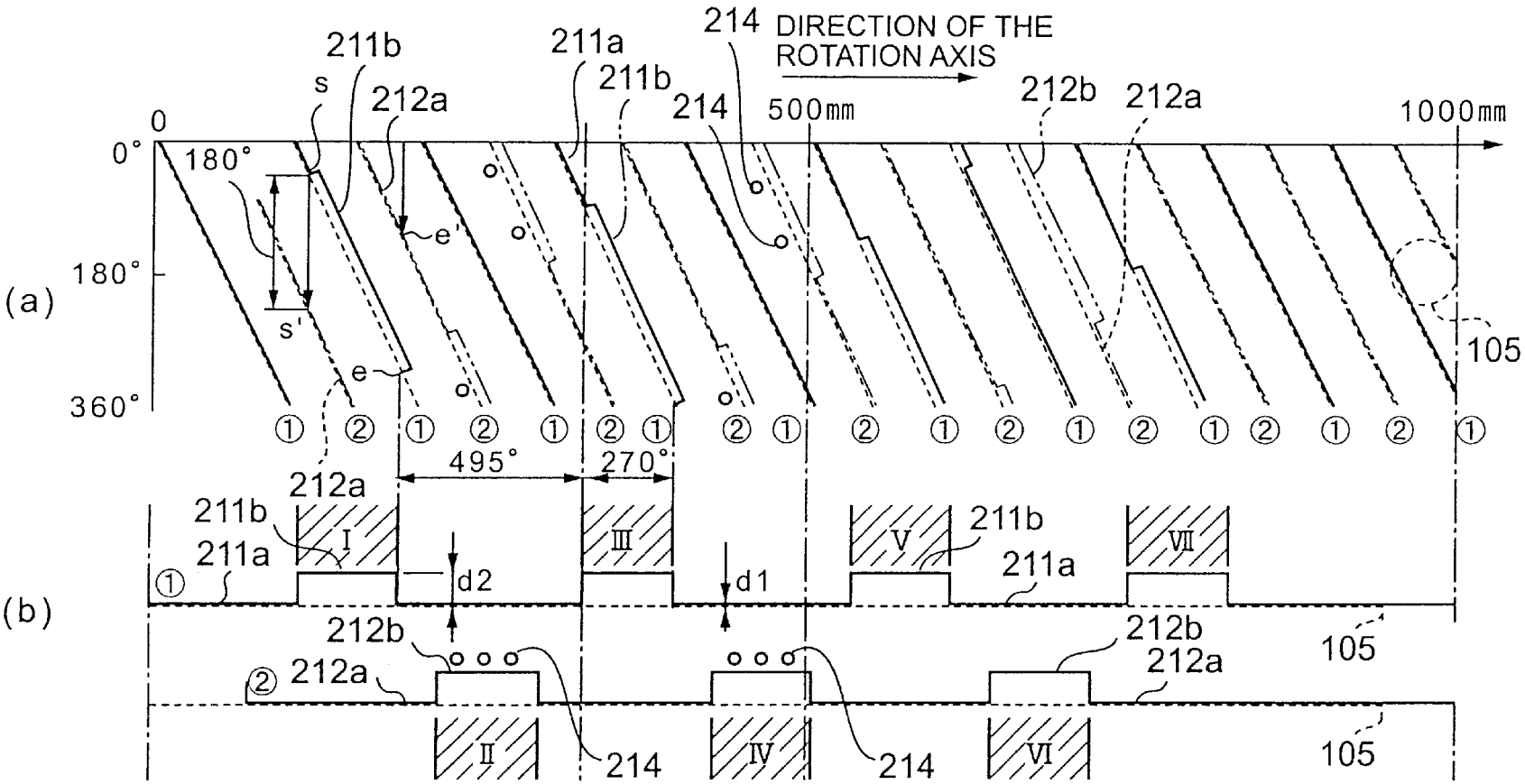
FIG. 2 is an explanatory drawing showing the configuration of the flight in the small diameter section according to the first embodiment of the present invention.

Referring now to FIG. 2, the small clearance portions 211*a*, 212*a*, and the large clearance portions 211*b*, 212*b* of the flights 211 and 212 will be described in detail. In FIG. 2, the circled FIG. 1 designates the first flight 211, and the circled FIG. 2 designates the second flight 212, and dotted lines designate the inner peripheral surface of the small diameter section. In the figure (a), a lateral axis represents the axial position of the flight in the small diameter section, and the vertical axis represents the angle of the flight about the axis of rotation C, so that the configurations of the flights 211, 212 are shown in this coordinate system. The figure (b) shows the configurations of the flights 211, 212 in the direction of the axis of rotation.

The axial dimension of the small diameter section of this embodiment is 1000 mm, and the first flight 211 is provided at the intervals of 100 mm along the whole length of the small diameter section. The second flight 212 is provided in a manner that each turn of the second flight is disposed between each two adjacent turns of the first flight 211 along almost the whole length of the small diameter section.

The large clearance portions 211*b*, 212*b* of the flights 211, 212 are formed at every 495° at the angle width of 270°. The small clearance portions 211*a*, 212*a* of the flights 211, 212 are formed at every 270° at the angle width of 495°. In the whole part of the large clearance portion 211*b*, (212*b*) of the flight 211, (212), when the large clearance portion 211*b* (212*b*) is rotated a half turn (180°), the small clearance portion 212*a*, (211*a*) of another flight 212, (211) located at the same axial position passes the same position. More specifically, the starting point s and the end point e of the large clearance portion 211*b* of the first flight 211 overlap with the points s' and e' on the small clearance portion 212*a* of the second flight 212 located at the same axial position. Therefore, the cake residue layer passed through the large clearance d2 between the inner peripheral surface of the small diameter section 103 and the large clearance portions 211*b*, 212*b* of the flights 211, 212 and persists thereon is transported to the cake discharging ports 105 by the small clearance portions 212*a*, 211*a* of other flights 212, 211.

For the purpose of illustration, regions of the residue layers of cake formed on the rear side of all the large clearance portions 211*b*, 212*b* of the flights 211, 212 are designated to be the first region of the cake residue layer I, the second region of the cake residue layer II, . . . and the seventh region of the cake residue layer VII.

In this embodiment, the washing fluid spray nozzles 214 are not provided for all the large clearance portions 211*b*, 212*b* of each flight 211, 212 on the side facing to the large diameter section, in other words, it is not provided in all the regions of residue layers of cake, but only in the second region of the cake residue layer II and the fourth region of the cake residue layer IV.

Figure 3:
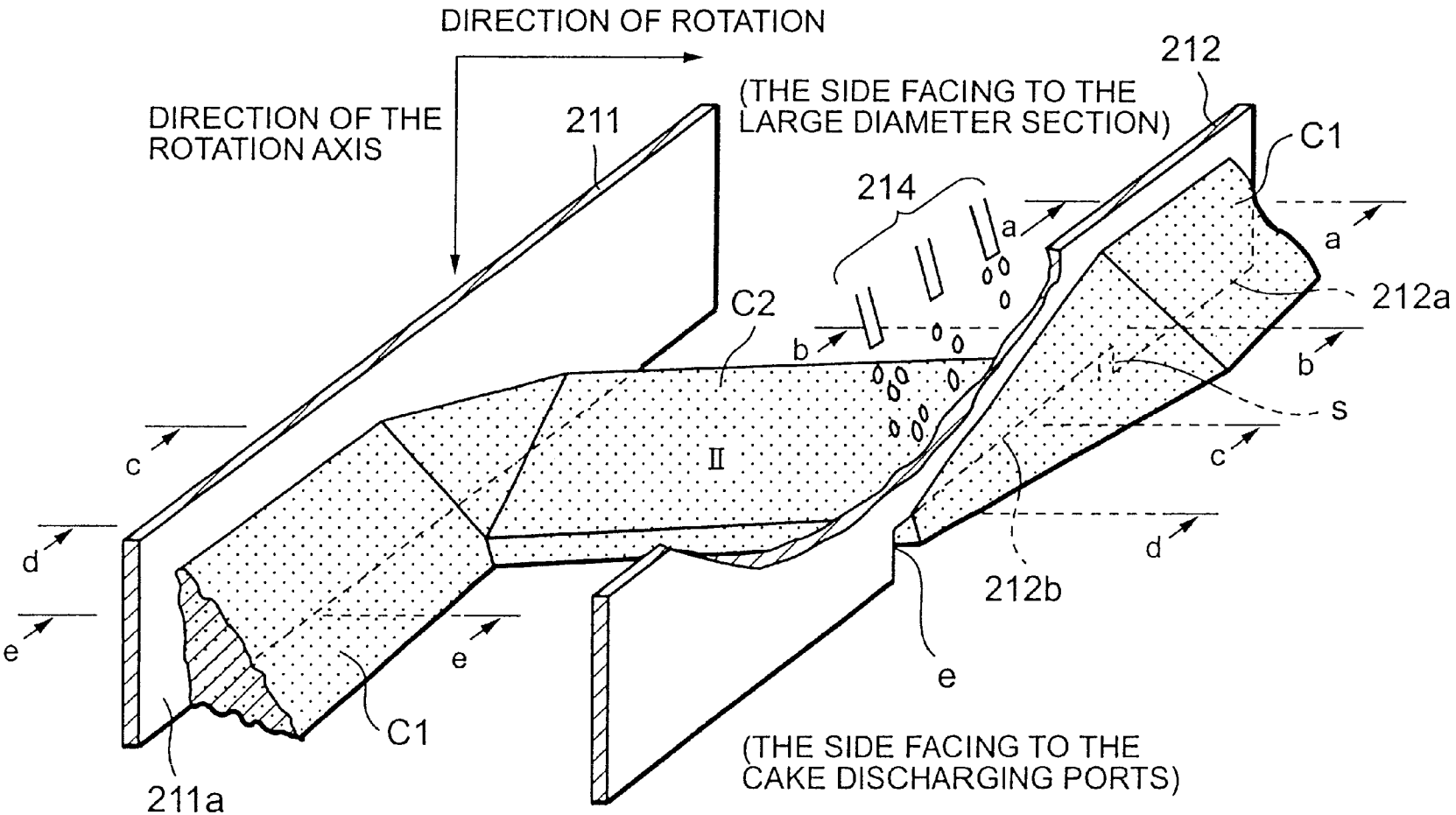
FIG. 3 is an explanatory drawing showing a state of the cake transportation and a state of the cake washing in a specific region of the small diameter section according to the first embodiment of the present invention.
Figure 4:
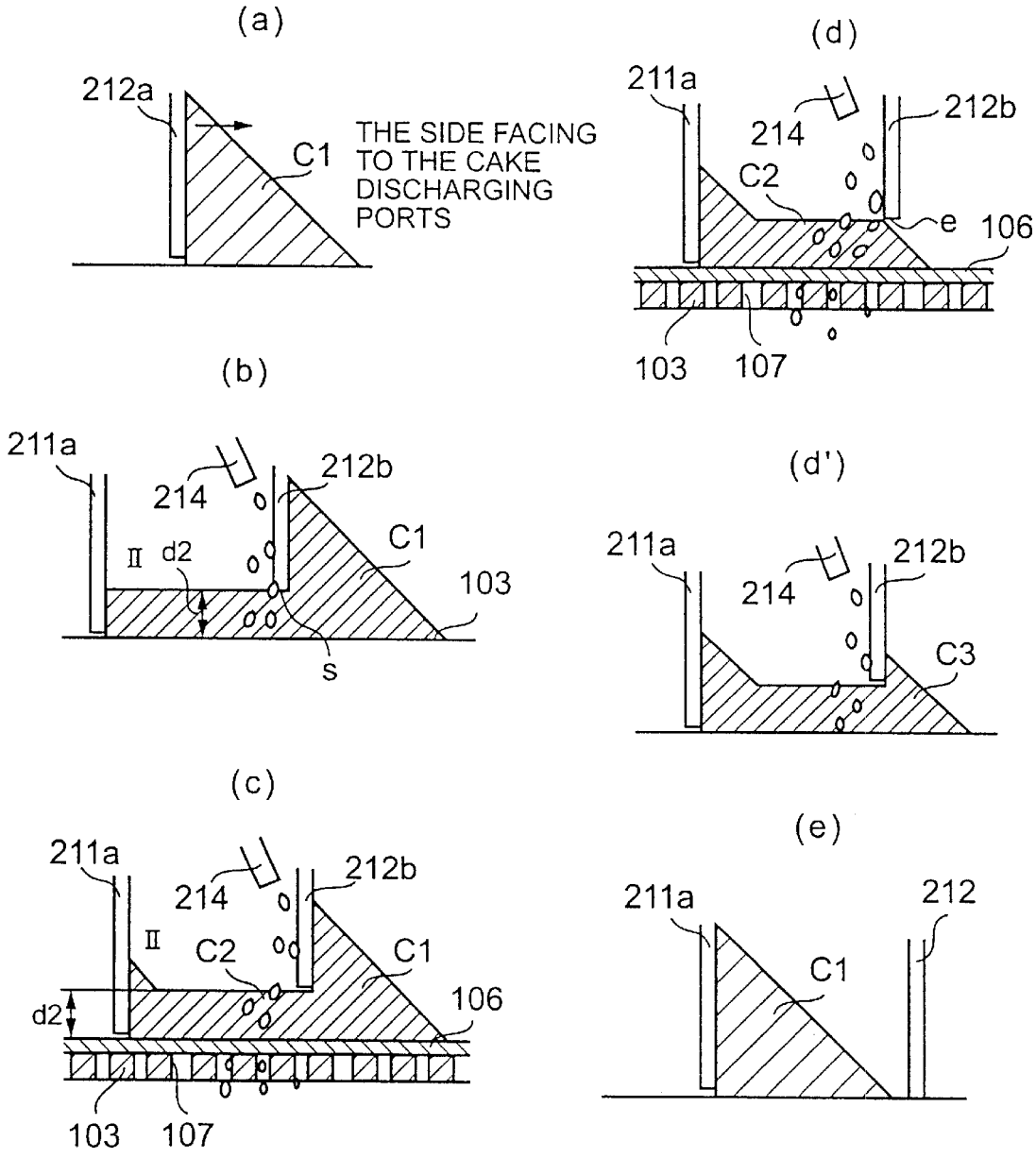
FIG. 4 is cross sectional views taken along lines in FIG. 3.

Referring to FIG. 3 and FIG. 4, the state of the cake transportation and the cake washing in a specific region (in the second region of the cake residue layer II and therearound) will now be described. In FIG. 3, the bowl is deployed and the flight is expressed in straight lines in the interest of clarity of the inner state of the small diameter section. The upper portion of the figure is the direction of the hub of the screw conveyor and the lower portion of the figure is the direction of the circumference of the small diameter section. FIGS. 4(*a*), (*b*), (*c*), (*d*), (*e*) are a cross section taken along the line a—a, a cross section taken along the line b—b, a cross section taken along the line c—c, the cross section taken along the line d—d, and the cross section taken along the line e—e respectively in FIG. 3. In FIG. 3 and FIG. 4, a very thin cake residue layer formed after the cake has passed through the clearance between the small clearance portions 211*a*, 212*a* of the flight and the inner peripheral surface of the small diameter section is omitted.

As shown in FIG. 3 and FIG. 4(*a*), in the process that the small clearance portion 212*a* of the second flight 212 moves toward the cake discharging ports, the cake C1 is pressed by the surface of the small clearance portion 212*a* of the flight on the side facing to the cake discharging ports and transported while being formed into generally triangle in cross section with one side situated on the surface of the flight, as mentioned in relation with the prior art.

As shown in FIG. 3 and FIGS. 4(*b*), (*c*), when the cake reaches the large clearance portion 212*b* of the second flight 212, the cake just passes through the large clearance d2 formed between the large clearance portion 212*b* and the inner peripheral surface of the small diameter section 103, and is not transported. As a consequence, a cake residue layer C2 is formed behind the large clearance portion 212*b*, in other words, in the second region of the cake residue layer II. Therefore, the quantity of the cake on the side of the cake discharging side (front side) of the large clearance portion 212*b* decreases gradually from the starting point s toward the end point e, and the cake to be transported disappears at the end point e. The cake residue layer C2 formed on the rear side of the large clearance portion 212*b* has a thickness corresponding to the depth of the large clearance d2.

The washing fluid from the washing fluid spray nozzles 214 are supplied onto the flight surface on the rear side of the large clearance portion 212*b* and the portion in which residue layers of cake C2 start to be formed. In other words, the washing fluid is supplied to the cake residue layer C2 successively in the process that cake passes from the large clearance portion 212*b* toward the rear and the cake residue layer C2 starts to be formed. Therefore, the washing fluid is applied uniformly on the whole surface of the cake residue layer C. The washing fluid applied on the portion in which the cake residue layer C2 starts to be formed penetrates into the cake layer in a very short time by centrifugal force generated by the rotation of the bowl 100 and moves into the porous material 106 while dissolving soluble component (impurities) in the cake layer, most part of which passes through the porous material 106 and discharged out of the machine through the filtrate discharging holes 107.

In this way, according to the present embodiment, since the washing fluid is supplied to the surface of the cake residue layer C2 that is generally vertical with respect to centrifugal force generated by the rotation of the bowl 100, the washing fluid does not flow on the surface of the cake, but most part of the washing fluid penetrates into the cake. Since the thickness of the cake residue layer C2 is smaller than that of the cake C1 of generally triangle in cross section, most part of the washing fluid applied to the cake residue layer C2 passes through the cake residue layer C2 and then through the porous material 106 and the filtrate discharging holes 107 and is discharged out of the machine almost without fail. In addition, according to this embodiment, the washing fluid is uniformly supplied on the whole surface of the cake residue layer C as described above. Therefore, according to this embodiment, a single washing operation produces a satisfactory and uniform washing effect for all the cake residue layer C2.

Since centrifugal force is always acting on the cake, a draining operation is always on the second region of the cake residue layer II. Therefore, according to this embodiment, since the draining operation acts uniformly upon the spread cake in the second region of the cake residue layer II, a satisfactory draining effect is also obtained.

The cake residue layer C2 passed through the large clearance portion 212*b* of the second flight 212 is scraped and collected sequentially by the small clearance portion 211*a* of the first flight 211 positioned behind the large clearance portion 212*b* of the second flight 212, as shown in FIG. 3 and FIGS. 4(*c*) and (*d*), and thus the cake is accumulated gradually in front of the small clearance portion 211*a*, and again, as shown in FIG. 3 and FIG. 4(*e*), a cake layer C1 of generally triangle in cross section is formed. The cake layer C1 is transported toward the cake discharging ports by the small clearance portion 211*a* of the first flight 211, and when it reaches the large clearance portion 211*b* of the first flight 211, it passes therethrough and forms again a cake residue layer C2 at the rear, in other words, at the third region of the cake residue layer III. In this way, in this embodiment, the washing effect and the draining effect are enhanced since the cake is broken and agitated every time when the cake is formed into generally triangular shapes in cross section and then into layers repetitively.

The cake is then continued to be processed in the same manner from the fourth region of the cake residue layer IV, . . . , to the seventh region of the cake residue layer VII, and finally transported to the cake discharging ports 105 and discharged therethrough to the outside. In this embodiment however, since the washing fluid spray nozzles 214 are provided only at the second region of the cake residue layer II and the fourth region of the cake residue layer IV, no washing fluid is supplied to the cake residue layer C2 at the third region of the cake residue layer III, the fifth region of the cake residue layer V, the sixth region of the cake residue layer VI, and the seventh region of the cake residue layer VII.

The reason why the washing fluid is supplied to the cake residue layer only at the second region of the cake residue layer II and the fourth region of the cake residue layer IV in this embodiment is that cake processed here is relatively low in fluid penetrating property. When the fluid penetrating property of the cake is low, even when the washing fluid is supplied in the second region of the cake residue layer, drainage cannot be completed in the second region of the cake residue layer. Therefore, when the washing fluid is supplied again in the third region of the cake residue layer, the washing fluid may stay on the cake layer and may result in lowering of the washing and draining effect instead. In contrast to it, when processing cake having a good fluid penetrating property, it is recommended to supply the washing fluid in the first region of the cake residue layer I, in the second region of the cake residue layer II, and in the third region of the cake residue layer III consecutively.

In this embodiment, it seems that forming the cake residue layer in the fifth, sixth, and seventh regions of residue layers of cake is meaningless because no washing fluid is supplied in the regions forward to the cake residue layer IV. However, it contributes to enhance the draining effect by applying centrifugal force repeatedly to the cake spread in layers.

Figure 5:
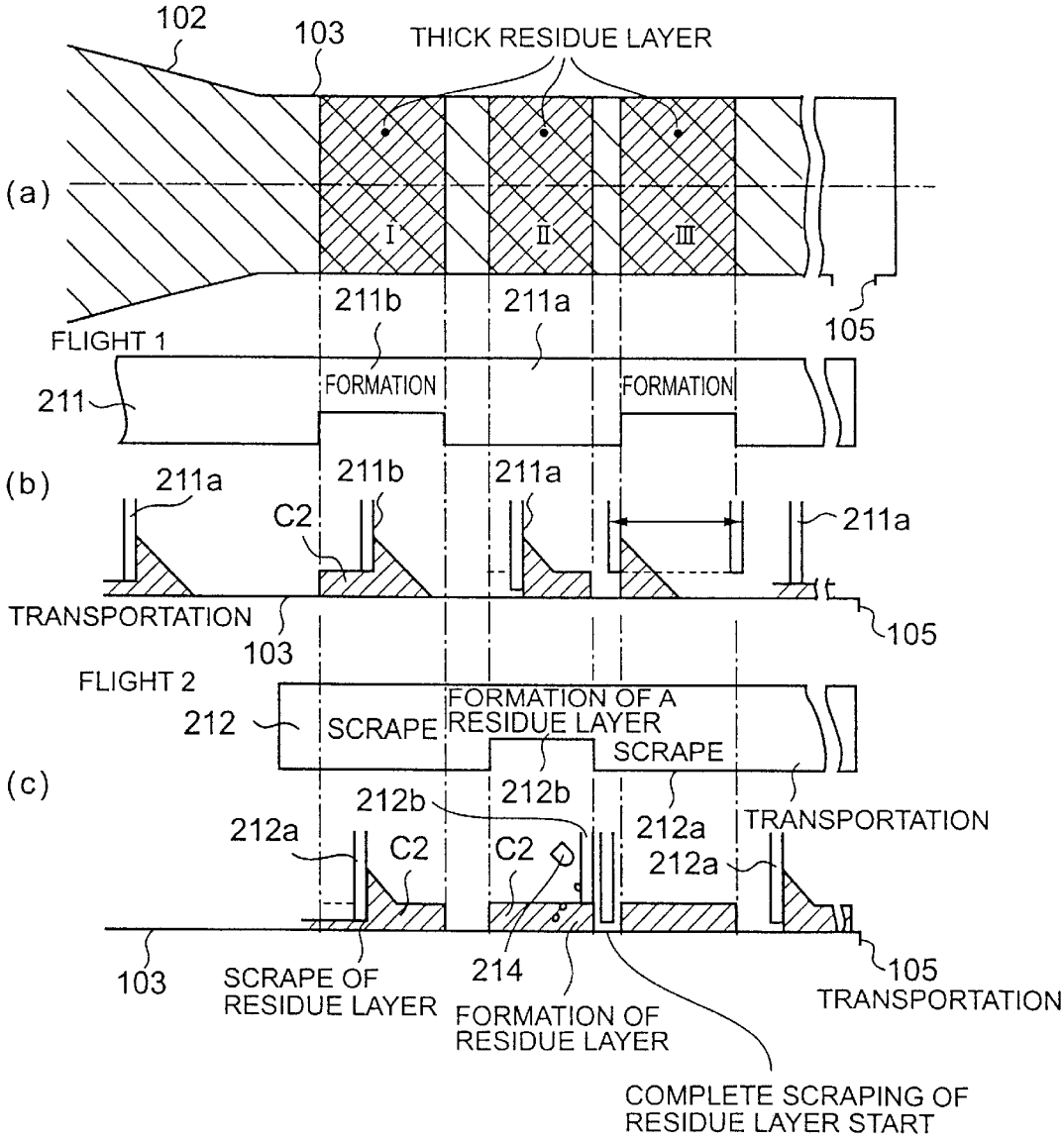
FIG. 5 is an explanatory drawing showing a state of the cake transportation at each position in the small diameter section according to the first embodiment of the present invention.

Referring now to FIG. 5, the conditions of the cake transportation at each axial position will be described.

When the cake is transported to the first region of the cake residue layer I by the small clearance portion 211*a* of the first flight 211, the first flight 211 is transitioned from the small clearance portion 211*a* to the large clearance portion 211*b*, and thus the cake residue layer C2 remains behind the large clearance portion 211*b* of the first flight 211 in the first region for forming the cake residue layer I. The cake residue layer C2 is scraped by the small clearance portion 212*a* of the second flight 212 that passes the first region for forming the cake residue layer I a half turn (180°) behind the large clearance portion 211*b* of the first flight 211 and transported to the second region for forming the cake residue layer II. The second flight 212 transitions from the small clearance portion 212*a* to the large clearance portion 212*b* when it reaches the second region for forming the cake residue layer II. Therefore, the cake residue layer C2 remains behind the large clearance portion 212*b* of the second flight 212 in the second region for forming the cake residue layer II, so that the washing fluid is supplied to the cake residue layer C2.

The cake residue layer C2 is scraped by the small clearance portion 211*a* of the first flight 211 passing a half turn (180°) behind the large clearance portion 212*b* of the second flight 212 through the second region for forming a cake residue layer II and transported to the third region for forming the cake residue layer III.

Likewise, the same process is repeated until the cake is transported to the cake discharging ports 105.

As is described thus far, in this embodiment, since the configuration of the flight in the small diameter section 103 and the position and orientation of the washing fluid spray nozzles 214 are modified so that the cake is spread out into a layer in the process of transporting cake in the small diameter section 103 and the washing fluid is supplied uniformly thereon, the washing effect and draining effect for the cake can be enhanced with very little increase of the cost of the apparatus.

The inventor manufactured a test machine of the decanter centrifuge according to this embodiment and conducted a test on this test machine with slurries of gypsum powder, terephthalic acid powder, or pulverized polyethylene terephthalate resin and so on dispersed in water with acetic acid added as an impurity. As a result it has been shown that the washing effect and the draining effect were satisfactory for all the objects to be processed which were subjected to the test.

In order to enhance the effect of the cake washing, as shown in FIG. 4(*d*), it is important that no cake remains in front of the large clearance portion 212*b* immediately before the large clearance portion 212*b* ends, in other words, a cake residue layer C2 having the same cross sectional area as the cake C1 of the same figure (a) is formed behind the large clearance portion 212*b*.

It is because if any cake remains in front of the large clearance portion 212*b* immediately before the large clearance portion 212*b* ends as shown in the same figure (d'), the cake C3 is transported by the small clearance portion without having supplied this cake C3 with the washing fluid. Therefore, it is preferable that the depth of the large clearance d2 and the length of the large clearance portions 211*b*, 212*b* are determined so that almost no cake remains downstream the large clearance portions 211*b*, 212*b* immediately before they are ended, in other words, so that no pressure from the cake is applied to the front surface of the flight at the large clearance portions 211*b*, 212*b*.

Now, specific depths of the small clearance d1 and the large clearance d2 will be described.

Assuming that the design conditions of the decanter centrifuge of this embodiment are as follows;

inner diameter of the small diameter section: 260 mm length of the small diameter section: 1000 mm pitch of the conveyor: 100 mm differential speed of the conveyor: 40 rpm amount of cake to be discharged: 18.3 litters/minute, Under the above-described conditions, the triangular cross sectional area of the cake C1 in FIG. 4(*a*) is approximately 5.6 $cm^2$. In order that all of the cake C1 is formed into the cake residue layer C2 as shown in FIG. 4(*d*), when the length of the large clearance portions 211*b*, 212*b* corresponds 360° as a simple example, the depth of the large clearance d2 has to be at least the depth of the small clearance d1 plus 5.6 mm. Since the length of the large clearance portions 211*b*, 212*b* of this embodiment is as long as the length corresponding to 270°, the depth of the large clearance d2 of this embodiment has to be at least the depth of the small clearance d1 plus 7.5 mm (=5.6 mm×360°/270°). However, since a loss of the cake during transportation by the flight, or a loss or a swell of the cake due to a resistance generated when being passed through the large clearance or due to slippage or drainage when being supplied with the washing fluid have to be considered in actual fact, the depth of the large clearance d2 is preferably determined to be 10 to 20% larger than the calculated value.

On the other hand, the small clearance d1 is preferably determined as small as possible, and thus it is normally set to 0.5 mm to 1.5 mm considering error in manufacturing of the machine or warpage of the screw conveyor.

In this embodiment, with these conditions in view, the depth of the small clearance d1 is set to 1.0 mm and the depth of the large clearance d2 is set to 9.6 mm (=1.0 mm+7.5 mm×1.15).

Figure 6:
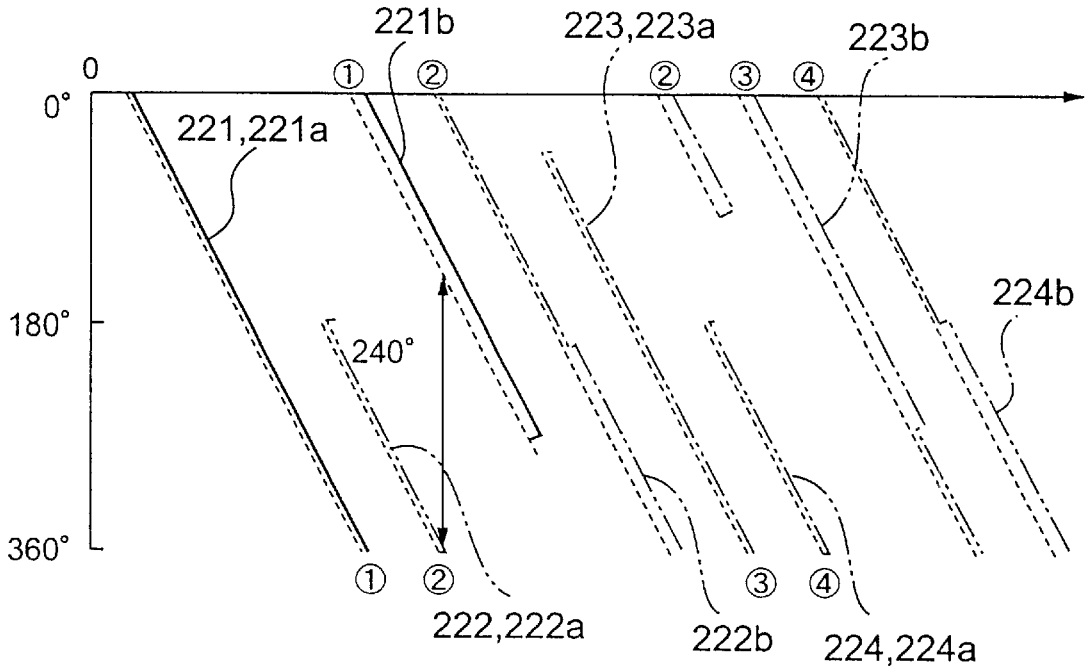
FIG. 6 is an explanatory drawing showing the configuration of the flight in the small diameter section according to the second embodiment of the present invention.

Referring now to FIG. 6, the second embodiment of the decanter centrifuge according to the present invention will be described. In FIG. 6 as well as in FIG. 2(*a*), the lateral axis represents the axial position of the small diameter section and the vertical axis represents the angle about the axis of rotation so as to show the configuration of each flight in this coordinate system.

The circled figures designate the number of the flight respectively.

As shown in FIG. 6, the small diameter section is provided with more than four flights in this embodiment. The flights 221, 222, 223, 224 have small clearance portions 221*a*, 222*a*, 223*a*, 224*a* and large clearance portions 221*b*, 222*b*, 223*b*, 224*b* respectively formed thereon. The whole region of the large clearance portions 221*b*, 222*b*, 223*b*, 224*b* of the flights 221, 222, 223, 224 is constructed in such a manner that when the large clearance portion makes a ⅔ turn (240°), the small clearance portion of another flight located at the same axial position passes through the same point.

In this way, even when three or more flights are provided in the small diameter section, basically the same effect as the first embodiment can be obtained. In this embodiment, the whole region of the large clearance portion of the flight is constructed in such a manner that when the large clearance portion makes a ⅔ turn (240°), the small clearance portion of another flight located at the same axial position passes through the same point. As the result of this, the period of time until a cake residue layer is scraped out by the small clearance portion of the next flight increases and more washing fluid is removed through the outer periphery of the small diameter section, thereby further enhancing the washing effect and the draining effect in comparison with the first embodiment.

What is claimed is:

1. A decanter centrifuge comprising:

a bowl;

a screw conveyer provided in said bowl so as to rotate relatively to said bowl;

said bowl comprising a cylindrical large diameter section into which slurry is supplied, a tapered section having the diameter decreasing from said large diameter section, and a small diameter section connected to the side of said tapered section having a smaller diameter;

said small diameter section having fine filtrate discharging holes formed on a part or all over the circumferential wall thereof and cake discharging ports formed at an end opposite from said large diameter section;

said small diameter section is provided with washing fluid supply means for supplying washing fluid to cake transported from said large diameter section through said tapered section;

wherein said screw conveyor includes a plurality of flights for transporting said cake to said cake discharging ports in said small diameter section;

said plurality of flights include a small clearance portion defining a small clearance and a large clearance portion defining a large clearance between the tip of said plurality of flights and the inner peripheral surface of said small diameter section respectively;

the whole region of said large clearance portion of said plurality of flights overlaps with said small clearance portion of another flight located at the same axial position of said screw conveyer.

2. A decanter centrifuge as set forth in claim 1, wherein said large clearance portion of said flight and said small clearance portion of another flight located at the same axial position are provided in such a manner that when said large clearance portion makes at least a half turn, said small clearance portion passes through the same point as said large clearance portion.

3. A decanter centrifuge as set forth in claim 1, wherein a depth of said large clearance and a length of said large clearance portion are determined in such a manner that said cake located at said large clearance portion on the side facing to said cake discharging ports passes through said large clearance formed between an inner peripheral surface of said small diameter section and the said large clearance portion while forming a cake residue layer substantially having the same thickness as said large clearance on the side of said large clearance portion facing to said large diameter section, and no contact pressure from said cake is applied to the surface of said large clearance portion of the flight facing to said cake discharging ports immediately before said large clearance portion ends and said small clearance portion starts.

4. A decanter centrifuge as set forth in any one of claims 1, 2 and 3, wherein said washing fluid supply means is provided in said large clearance portion on the side facing to said large diameter section.

5. A decanter centrifuge as set forth in claim 4, wherein said washing fluid supply means is provided so as to be able to spray said washing fluid onto the surface of said large clearance portion of the flight on the side facing to said large diameter section.

* * * * *